United States Patent [19]

Steinback

[11] 4,407,096

[45] Oct. 4, 1983

[54] METHOD AND APPARATUS FOR SURFACE GRINDING

[75] Inventor: Clarence I. Steinback, Minneapolis, Minn.

[73] Assignee: Acrometal Products, Inc., Minneapolis, Minn.

[21] Appl. No.: 341,497

[22] Filed: Jan. 21, 1982

Related U.S. Application Data

[63] Continuation of Ser. No. 149,905, May 15, 1980, abandoned.

[51] Int. Cl.[3] ..... B24B 21/04; B24B 1/00

[52] U.S. Cl. ..... 51/328; 51/135 R; 51/135 BT; 51/142; 51/144; 51/145 R

[58] Field of Search ..... 51/94 WH, 131.3, 135 R, 51/135 BT, 142, 143, 144, 145 R, 145 T, 328

[56] References Cited

U.S. PATENT DOCUMENTS

| | | | |
|---|---|---|---|
| 915,174 | 3/1909 | Hanson | 51/131.3 |
| 1,262,540 | 4/1918 | Miller | 51/95 WH |
| 1,926,779 | 9/1933 | Law | 51/131.3 |
| 2,996,848 | 8/1961 | Thompson | 51/95 WH |
| 3,154,896 | 11/1964 | Olton et al. | 51/328 |
| 3,665,650 | 5/1972 | Przygocki | 51/142 |
| 3,668,814 | 6/1972 | Freerks et al. | 51/145 R |
| 3,816,998 | 6/1974 | Griuna et al. | 51/145 T |
| 3,888,050 | 6/1975 | Elm | 51/135 R |
| 3,971,166 | 7/1976 | Habeck et al. | 51/135 BT |
| 4,021,970 | 5/1977 | Przygocki | 51/135 BT |

*Primary Examiner*—James G. Smith
*Assistant Examiner*—K. Bradford Adolphson
*Attorney, Agent, or Firm*—Michael B. Lasky

[57] ABSTRACT

A surface grinding method in a first embodiment of which a workpiece supported on a surface (56) is rotated about a vertical axis while being translated along ways (46, 47) past a cutting head (22) comprising an abrasive belt (71) driven about a drum (72) to have a working edge (17) skewed with respect to the direction of the ways. In other embodiments the workpiece (100) is fed axially into the belt (106), which may be oscillated transversely to the direction of feed, and the workpiece may be moved, in the direction of the working edge, out of engagement with the belt while the belt and workpiece are in motion.

4 Claims, 12 Drawing Figures

METHOD AND APPARATUS FOR SURFACE GRINDING

CROSS REFERENCE

This application is a continuation of the patent application of the same title, Ser. No. 149,905, filed May 15, 1980, now abandoned.

BACKGROUND OF THE INVENTION

In the art of surface grinding, solid abrasive wheels are increasingly being replaced by endless abrasive belts passing around cylindrical driving drums, and the belts are very effective for removing metal efficiently.

Where it is desired to produce a very flat surface of exact dimensions, however, in mass production of a number of identical objects for example, difficulty is encountered. In the movement of a succession of workpieces past an abrasive belt, certain portions across the width of the belt encounter metal for longer working intervals than others, and consequently are worn away more rapidly. Under such conditions the first fifty or so units may be flat within required tolerances, but thereafter the belt, while still usefully cutting metal, nevertheless produces a surface which increasingly departs from flatness with successive workpieces. Accordingly the belt must be replaced, even though it would still be capable of grinding perhaps 150 more pieces to a less exacting flatness tolerance.

The foregoing is true whether the work is fed past the abrasive belt linearly, or rotated and fed into the belt along the axis of rotation. While the situation can in some measure be alleviated by differently positioning successive workpieces for grinding, this repeated jigging adjustment is not consonant with efficient mass production.

SUMMARY OF THE INVENTION

The present invention resides in an improved method for surface grinding by the use of abrasive belts, by which all parts of the belt are brought equally into contact with the object to be ground, so that the workpiece itself continuously "dresses" the belt, and it is possible to produce work which is flat within required tolerances throughout the cutting life of the belt. This is accomplished by providing a complex relative motion between the workpieces and the belt, the motion having both linear and rotational components.

Various advantages and features of novelty which characterize the invention are pointed out with particularity in the claims annexed hereto and forming a part hereof. However, for a better understanding of the invention, its advantages, and objects attained by its use, reference should be had to the drawing which forms a further part hereof, and to the accompanying descriptive matter, in which there are illustrated and described certain preferred embodiments of the invention. In the drawing, like reference numerals indicate corresponding parts throughout the several views.

BRIEF DESCRIPTION OF THE DRAWING

In the drawing, FIGS. 1 and 2 diagrammatically show characteristics of prior art procedures.

DESCRIPTION OF A FIRST EMBODIMENT OF THE INVENTION

Figure 1:
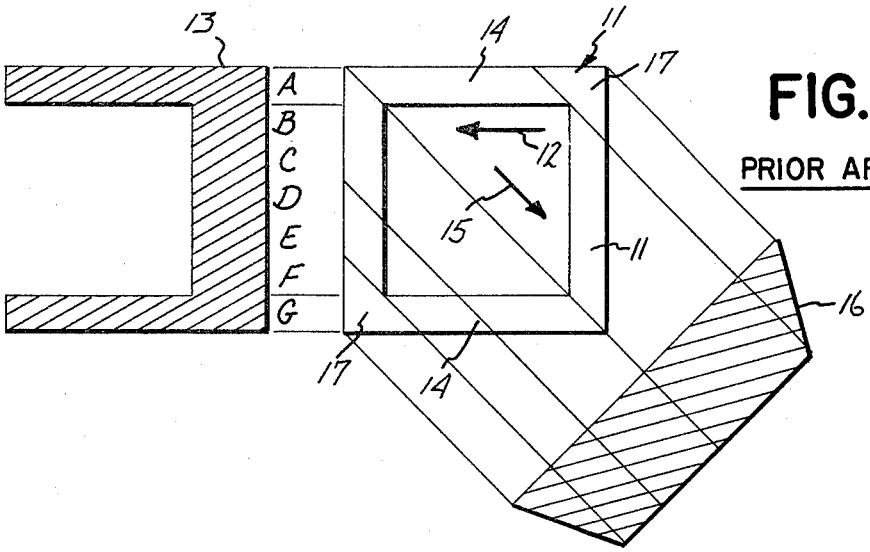
FIG. 1 PRIOR ART
Figure 2:
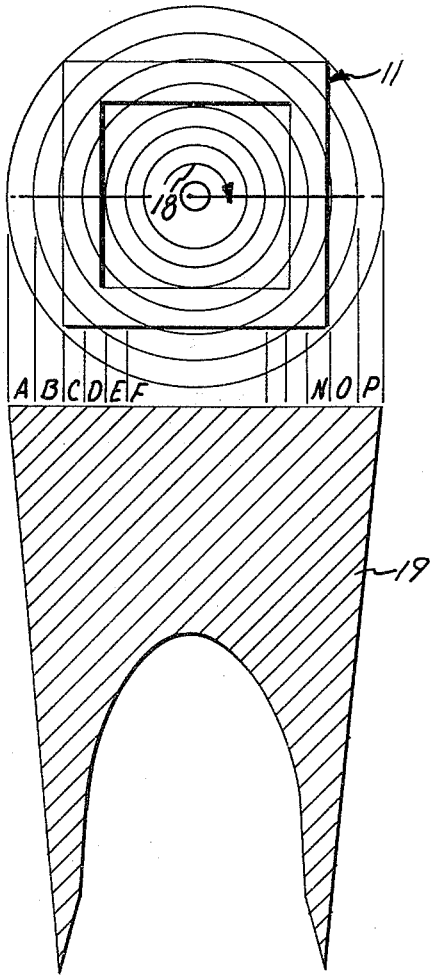
FIG. 2 PRIOR ART

Preliminary consideration should first be given to FIGS. 1 and 2, which are presented to illustrate the problem my invention is intended to solve. In FIG. 1, reference numeral 11 identifies a hollow metallic workpiece having an upper surface to be ground. If this workpiece is moved past an abrasive belt in the direction of arrow 12, normal to the working edge of the belt, diagram 13 shows the relative lengths of time during which transverse elements A, B . . . G of the belt engage the workpiece. It is obvious that elements A and G do over three times as much work as the other elements, and therefore wear down much faster. After a number of workpieces have passed the belt, the finished surfaces will no longer be flat, edges 14 being higher than the rest because the abrasive belt worn is lower in those regions.

If the work is moved in the direction of arrow 15 against the working edge of the belt, diagram 16 shows that most of the transverse elements of the belt engage the workpiece for the same intervals, but that the two outermost elements do not do so. In this arrangement grinding will result in high corners 17 after belt wear has begun to take place.

In FIG. 2, the workpiece 11 is rotated with respect to the working edge of the belt, as shown by the arrow 18, and is fed axially to the belt. Here again, the different transverse belt portions are subject to different degrees of wear, as suggested by diagram 19, and the finish on workpieces after an interval will have high circular ridges where belt elements C and N have been worn down. The present invention minimizes these effects.

Figures 3, 6:
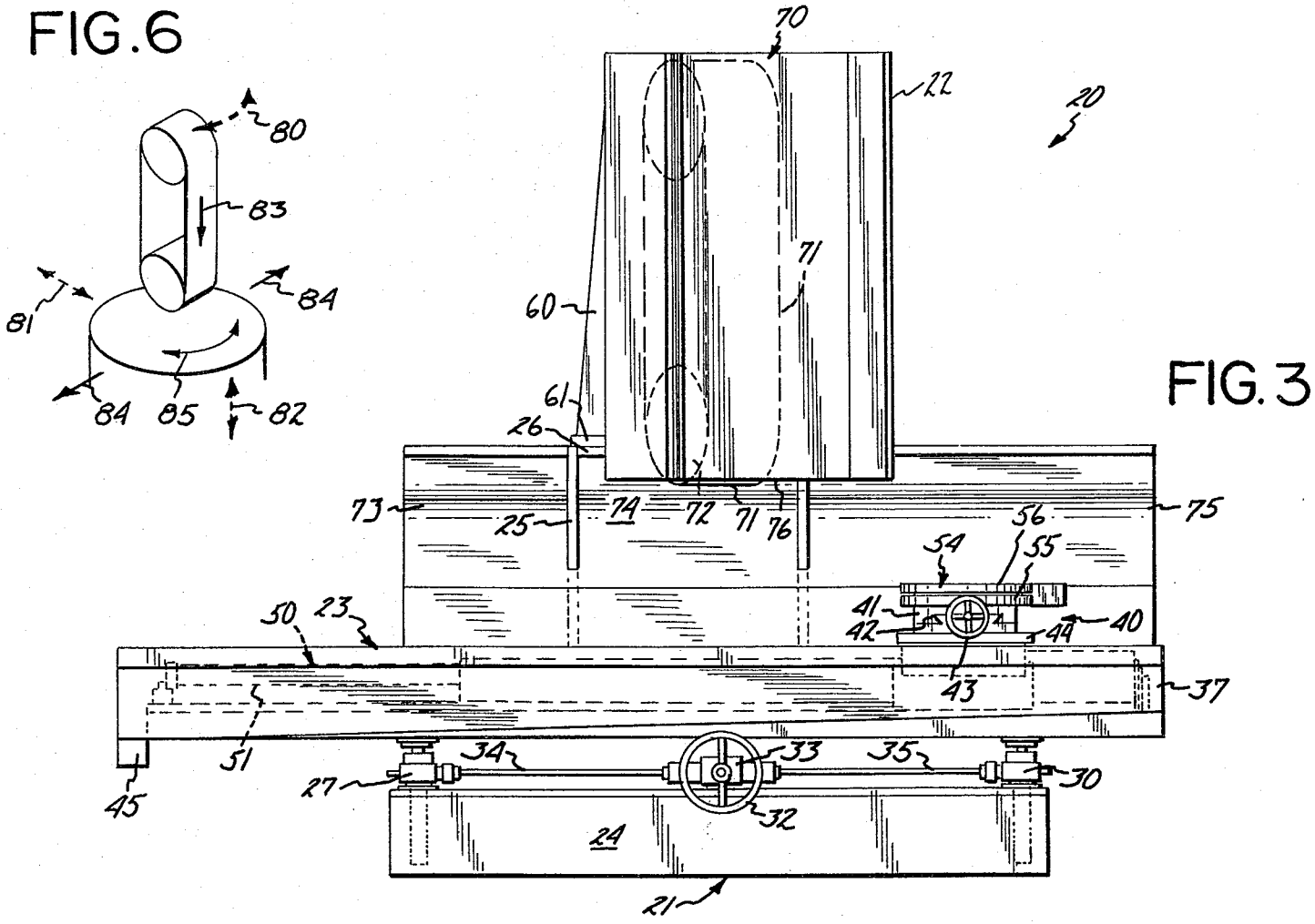
FIG. 3 is a front elevation of a first surface grinder embodying the invention.
FIG. 6 is a diagram showing motions available in the grinder of FIG. 3.
Figure 4:
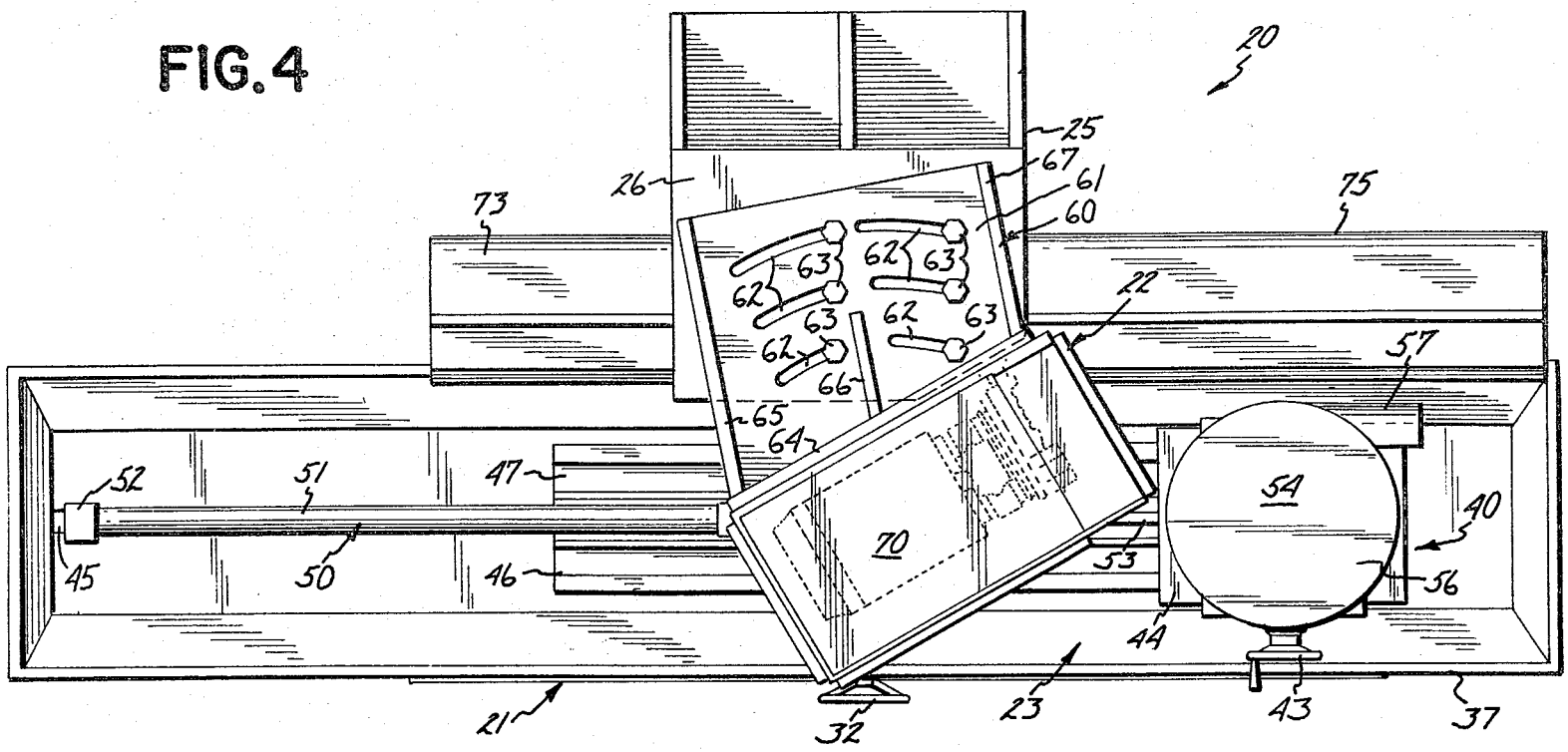
FIG. 4 is a plan view of the grinder of FIG. 3 to a larger scale.
Figure 5:
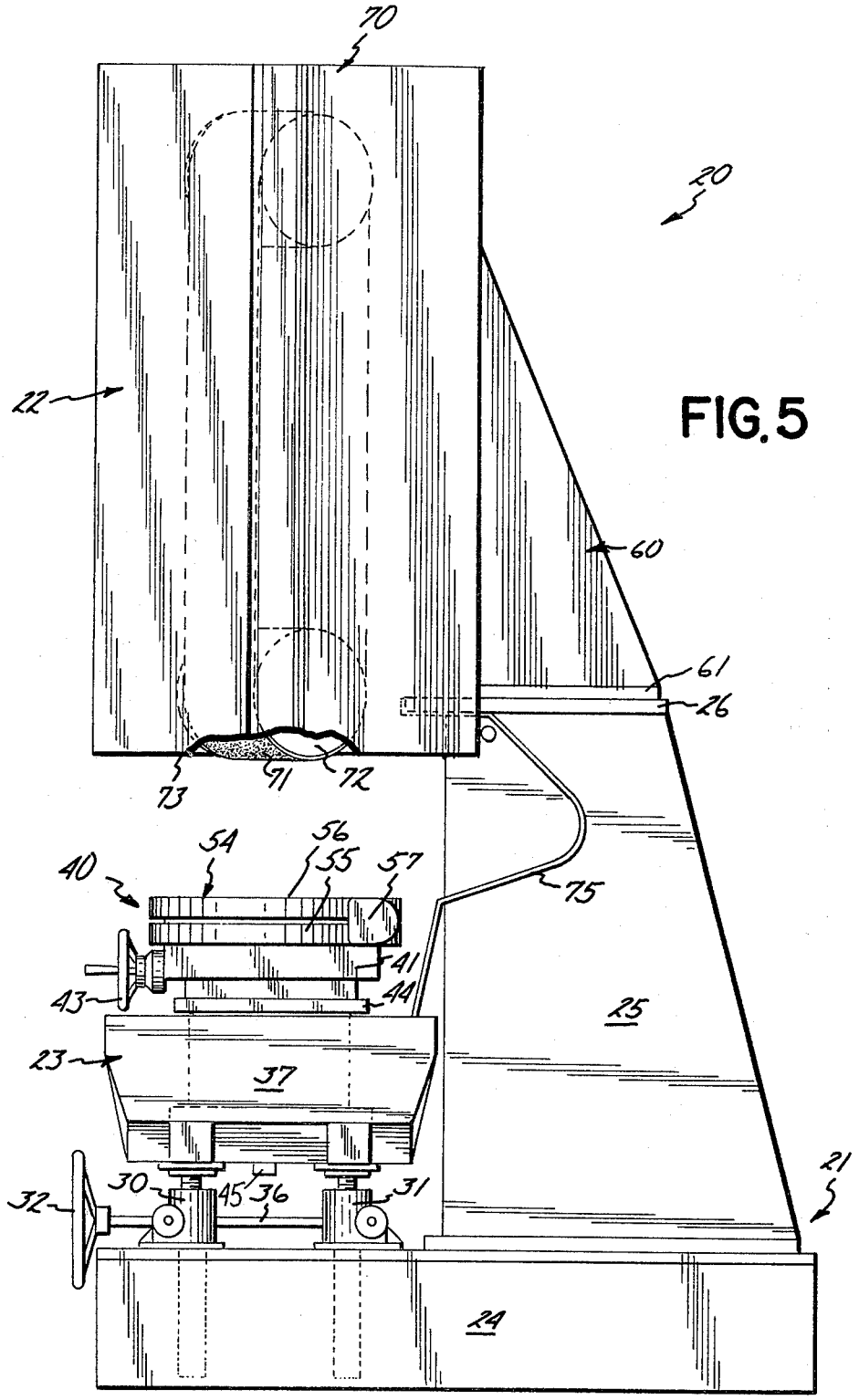
FIG. 5 is a side elevation of the grinder to a still larger scale, parts being broken away for clarity of illustration.
Figure 7:
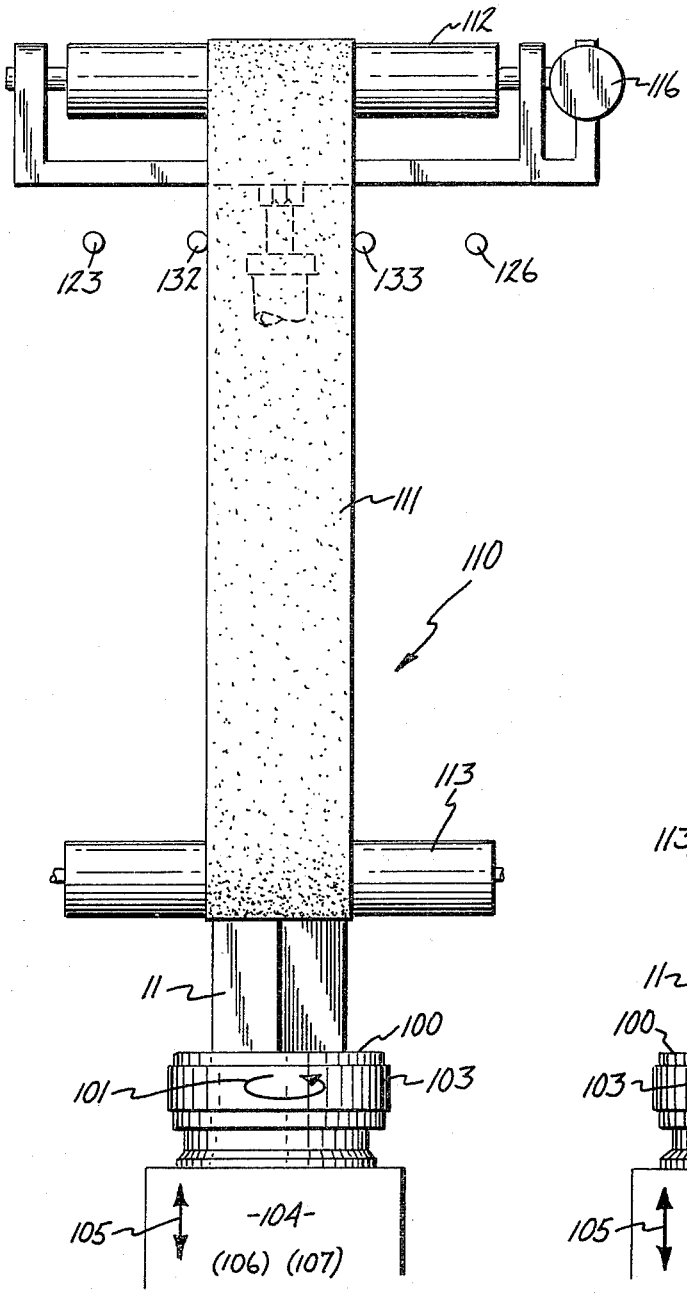
FIG. 7 is a schematic showing in side elevation of a second embodiment of the invention.
Figure 9:
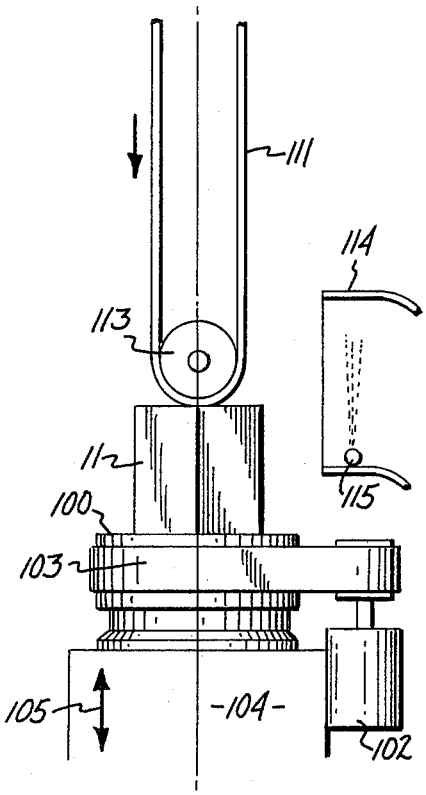
FIG. 9 is a fragmentary view in front elevation of the grinder of FIG. 7.

Turning now to FIGS. 3–5, a surface grinder 20 according to my invention, comprises a bed 21, a cutting head 22, and a work holder 23. Bed 21 includes a base 24 and a pedestal 25 secured thereto or integral therewith so that a flat upper plate 26 of the pedestal is horizontal. Base 24 extends horizontally beyond pedestal 25 to support work holder 23 for vertical adjustment on a set of four screw jacks, three of which are shown at 27, 30 and 31, arranged for simultaneous operation by means including a handwheel 32, a mechanical interconnection 33, and driving rods 34, 35, 36, to raise and lower an elongated horizontal carrier 37 for a worktable 40.

Table 40 includes a cross slide 41 arranged for linear transverse adjusting movement in dovetail ways 42 by a hand wheel 43. Table 40 is mounted for movement longitudinally on carrier 37 by a carriage 44.

Carrier 37 is formed as a trough to receive lubricoolant, when such is used, and deliver it for recirculation through a connection 45. The carrier includes a pair of horizontal ways 46, 47 on which carriage 44 is mounted for sliding motion past pedestal 25 by operation of a linear hydraulic motor 50 having a cylinder 51 secured to carrier 37 at 52, and a piston 53 secured to carriage 44. By conventional hydraulic circuitry, not shown, motor 50 may be actuated to move carriage 44 horizontally along ways 46, 47 past pedestal 25 in either direction.

Table 40 includes a rotator 54 having a base 55, fixed to the top thereof as by a magnetic clutch in cross slide 41, and a working surface 56 to receive jigs for holding workpieces to be ground. Suitable hydraulic or electric motor means 57 is provided for causing rotation of working surface 56 with respect to base 55 about a vertical axis, under the control of conventional circuitry not shown.

Cutting head 22 comprises an angle plate 60 having a flat horizontal member 61 formed with a plurality of concentric arcuate slots 62 for securement to plate 26 of pedestal 25 by fasteners 63, the arrangement being such as to permit pivotal adjustment of the angle plate on the pedestal. A vertical member 64 is reinforced in angle plate 60 by gussets 65, 66 and 67, and supports a housing 70 containing an abrasive belt structure including an endless abrasive belt 71 driven around a lower contact drum 72 by conventional drive, centering, and tensioning means, not shown, so that the belt and drum project at the bottom of a housing 73 to present a cylindrical abrasive surface moving with a component of rotation about the axis of drum 72. That axis is horizontal, and is skewed with respect to the direction of linear movement of the table, the angle of skew being adjustable at slots 62 and fasteners 63. When the depth of cut is only a few thousands of an inch, the belt may be said to have a "working edge", which is a straight line parallel to the axis of drum 72 where the travel of the belt is at its lowest.

It will be appreciated that if wet grinding is to be carried on, suitable splash guards can be provided as suggested at 73, 74, 75, 76 to extend the full length of bed 21.

Attention is now directed to FIG. 6, in which adjustments available in setting up the apparatus are shown by broken lines, and motions occuring in operation of the grinder are shown by solid lines. Arrow 80 shows the pivotal adjustment available to head 22 by reason of slots 62. Arrow 81 shows the transverse movement made available for table 40 by hand wheel 43. Arrow 82 shows the vertical adjustment available to carrier 37 by hand wheel 32. Arrow 83 shows the movement of belt 70. Arrows 84, 84 show the linear movement of table 40 along ways 46, 47. Arrow 85 shows the rotary movement available to table 40 by operation of motor 57.

An illustrative embodiment of the invention has the following characteristics:

Speed of belt 71—7000 s.f.p.m.
Width of belt 71—3 to 6 inches
Belt grit—70 to 220
Horizontal travel of carriage 44—60 inches
Working lineal speed of carriage 44—infinitely variable—0 to 21 inches/second
Diameter of surface 56—20 inches
Vertical movement of carrier 37—12 inches
Minimum clearance between working surface 56 and belt 71—10 inches
Speed of rotator 54—0 to 600 r.p.m. variable

OPERATION OF THE FIRST EMBODIMENT

The operation of the grinder is as follows. A jig or holder (not shown) appropriate to the configuration of pieces to be ground in mass production is secured to surface 56 magnetically or by suitable clamps. Such pieces are typically the product of a previous machining or grinding step, and are interchangeably insertable in a suitable jig so that a surface to be ground flat is upward and horizontal, and so that only a few thousands of an inch need to be removed from that surface. The machine is shown in FIG. 3 with table 40 at a first "loading" station, where a workpiece is manually loaded into the jig. Hand wheel 43 is rotated to center the jig on the longitudinal path of the carriage. A belt of suitable width and grit is inserted, centered, and tensioned in head 22, and the latter is pivotally adjusted at slots 62 to give the desired angle of skew between the axis of drum 72 and the direction of linear carriage movement. Hand wheel 32 is rotated to set the depth of cut for the belt as desired, the belt drive is initiated, and motors 57 and 50 are set in operation.

Carriage 44 is now being driven to the left as seen in FIG. 3, moving quite slowly, and motor 57 is causing rotation of the workpiece about a vertical axis at a considerably higher peripheral speed. As the workpiece is displaced and rotated under the belt, any given point on the surface of the workpiece engages many different sites transversely of the belt in a complex pattern such that no belt site is cutting material for a longer interval than any other.

When the table reaches the end of its stroke it has reached a second "loading" station, where the finished piece can be unloaded and another added for movement past the belt in the opposite direction. This arrangement is one in which the work itself "dresses" the abrasive surface, keeping it everywhere the same thickness, so that the workpiece is given a truly flat finish in which the scratch pattern is well confused and no extended scratches exist at the surface for later trouble with minor leaks past a sealing surface.

It will be evident that successive pieces ground on this machine will all meet flatness tolerances because the abrasive belt is being worn uniformly. If dimensional tolerances are also critical, suitable small changes in the level of carrier 37 may be made to compensate for wear of the abrasive and to keep dimensions acceptable.

DESCRIPTION OF A SECOND EMBODIMENT OF THE INVENTION

A grinder as shown in FIGS. 3–5 has many precision components and is costly to build and maintain. For many purposes the advantages of my invention can be obtained in a simplified embodiment shown, somewhat schematically, in FIGS. 7, 8, 9, and 10. Here a workpiece 11, which may, for example, be that shown in FIG. 1, is mounted in any conventional fashion upon a table 100 capable of rotating about a vertical axis as suggested by the arrow 101 and rotated at either of two speeds by a rotary hydraulic motor 102 through a belt 103. Table 100 is mounted on a carriage 104 having vertical motion as indicated by the arrows 105, which may conveniently include a hydraulic feed for rapid action and a mechanical feed for fine action, suggested at 106 and 107.

A cutting head 110, generally like head 22 of FIGS. 3–5, is positioned above table 100, and includes an abrasive belt 111 driven by suitable motor means not shown over upper and lower horizontal cylindrical drums 112 and 113. The belt is considerably narrower than the drums, and at least the lower drum is of steel or other hard durometer material. A simple splash guard 114 of length determined by the maximum belt width may be mounted as suggested in FIG. 9, to collect the swarf resulting from the grinding process, and may include a water curtain arrangement 115. Conventional driving and tensioning means are provided, as is a centering arrangement modified as will now be described.

Figure 8:
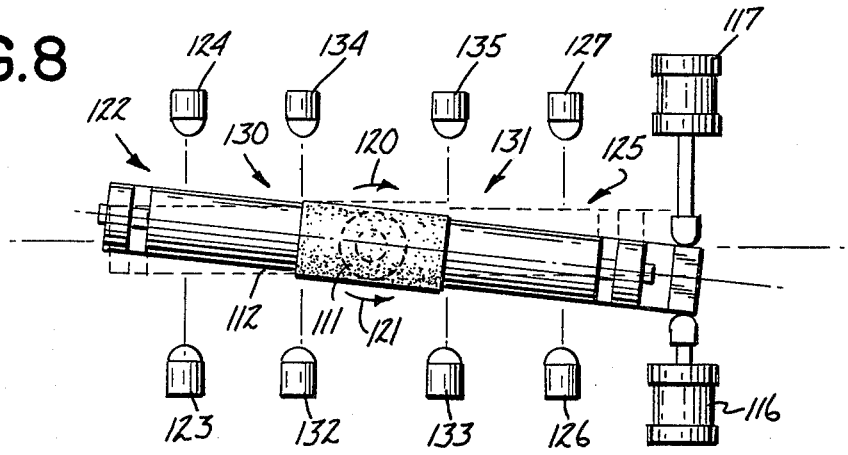
FIG. 8 is a fragmentary plan view of the grinder of FIG. 7.
Figure 10:
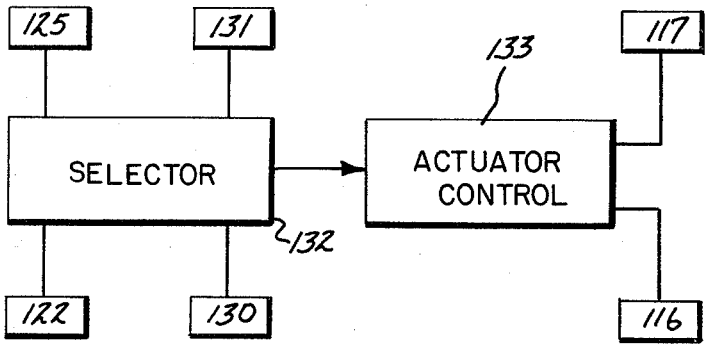
FIG. 10 is a diagram showing a control arrangement for the grinder of FIGS. 7–9.

FIG. 8 shows that upper drum 112 is mounted for slight pivotal movement about a vertical axis by operation of actuators 116 and 117 which pivot the drum in opposite directions, as suggested by the arrows 120 and 121: the extent of the motion is somewhat exaggerated in the figure. A first sensor 122 comprising a photocell 123 and a lamp 124 causes operation of actuator 116, when the edge of the abrasive belt reaches a limit of motion to the left, to pivot drum 112 in the direction of arrow 121, and a second sensor 125 comprising a photocell 126 and lamp 127 causes operation of actuator 117, when the edge of the abrasive belt reaches the limit of motion to the right, to pivot drum 112 in the direction of arrow 120.

While this arrangement is satisfactory for centering a full-width belt in the cutting head 22 of the first embodiment, it has been modified for use with the narrower belts of the second embodiment by the provision of further sensors 130 and 131 comprising photocells 132 and 133 and lamps 134 and 135. These can be positioned to be spaced by slightly more than the actual width of belt 111, and centered with respect to the length of drums 112 and 113. Control of actuators 116 and 117 can be transferred from sensors 122 and 125 to sensors 130 and 131, as is suggested in FIG. 10, by operation of a simple selector 132 connected between the sensors and the actuator controller 133.

In this embodiment of the invention no component for moving table 100 in a direction orthogonal to its axis of rotation is necessary.

OPERATION OF THE SECOND EMBODIMENT OF THE INVENTION

The operation of the grinder is as follows. The width of belt 111 is selected to be not much greater than the greatest transverse dimension of workpiece 11 taken through the axis of rotation, and sensors 130 and 131 are spaced accordingly. A workpiece 11 is mounted on table 100, which is then set in slow rotation. Belt 111 is placed in operation under the centering control of sensors 130 and 131, and therefore remains at substantially the same axial position along drum 113. Carriage 104 is raised until the workpiece almost engages the belt, and is then set into slow upward motion so that the belt makes a "plunge" cut directly into the top of the workpiece as the latter rotates.

When the desired amount of metal has been removed from the workpiece, the vertical movement of the carriage is stopped, the rotary speed of the table is increased, and centering control of the belt is transferred to sensors 122 and 125. Belt 111 now moves back and forth across the full width of drums 112 and 113 as the workpiece rotates, so that every part of the belt comes into alignment with every part of the workpiece, and the latter is given a fine finish, at the same time "dressing" the belt so that the wear on it is everywhere the same. The travel of the belt axially of the drums is preferably equal to the sum of twice the belt's width added to the greatest transverse dimension of the workpiece normal to the axis of rotation. After the piece is finished the table is lowered, its rotation is stopped, and the workpiece is replaced so that the process can be continued.

DESCRIPTION OF A THIRD EMBODIMENT OF THE INVENTION

Figure 11:
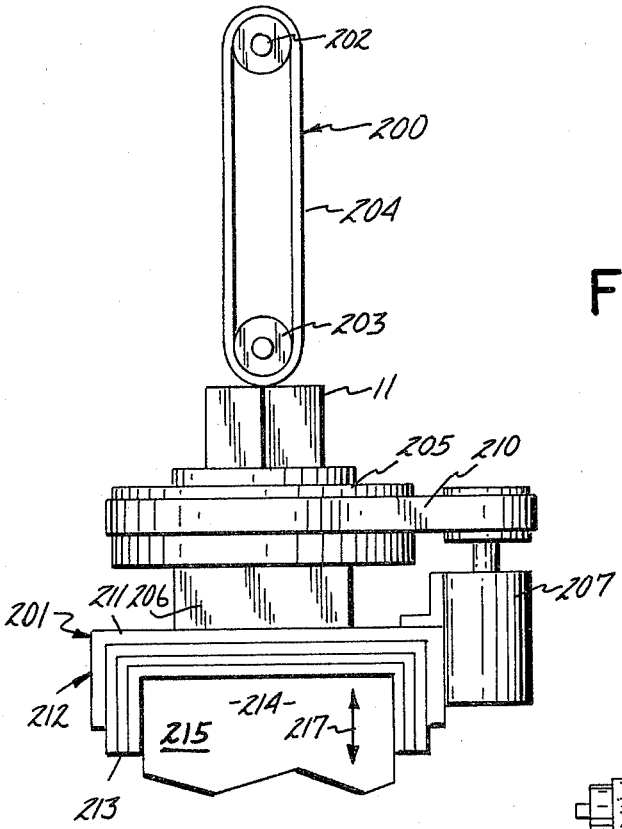
FIG. 11 is a schematic showing in front elevation of a third embodiment of the invention.
Figure 12:
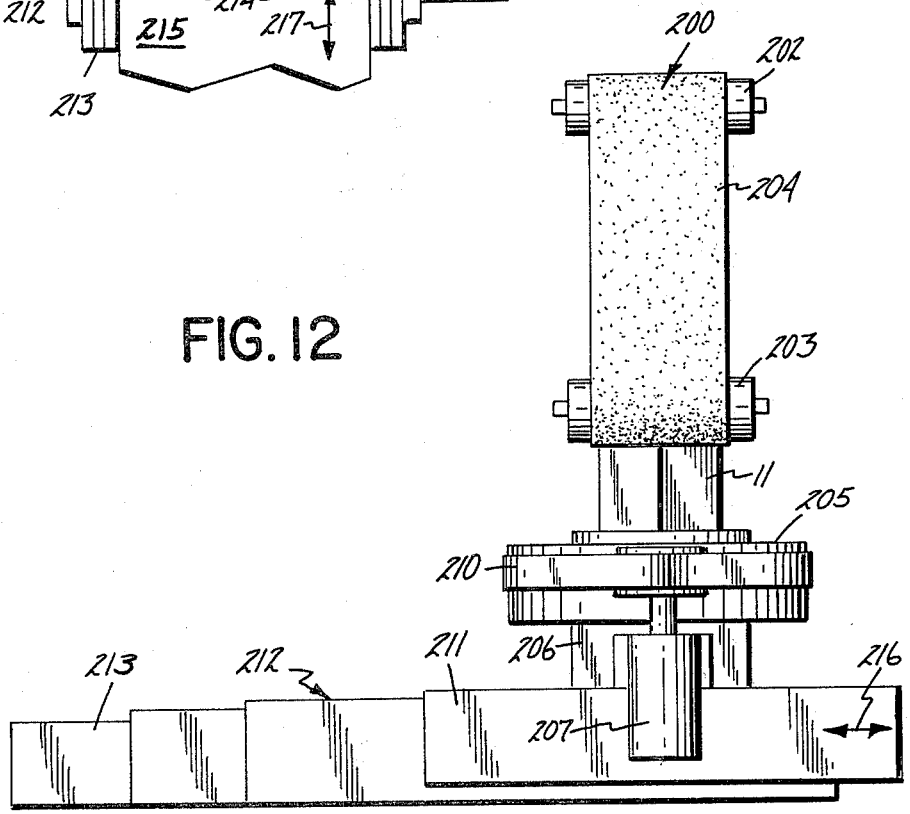
FIG. 12 is a similar view of the structure of FIG. 11 in side elevation.

Referring now to FIGS. 11 and 12, a third preferred embodiment of the invention is shown to comprise a cutting head 200 mounted over a workholder 201. Cutting head 200 is alternatively like head 110 of FIGS. 7–9, and includes upper and lower drums 202 and 203 traversed by an abrasive belt 204. Conventional mounting, drive, and belt centering means not shown are included.

A workpiece is mounted in any conventional fashion on a table 205, which is mounted on a carriage 206 and is capable of rotation about a vertical axis by a hydraulic motor 207 through a belt 210. Carriage 206 and motor 207 are mounted on the outer slide 211 of a nest 212 of such slides, to enable horizontal linear movement of carriage 206 in a direction parallel to the axis of drum 203 and hence to the working edge of belt 204. The inmost slide 213 of nest 212 is carried by a suitable support 214, and hydraulic means suggested at 215 cause movement of carriage 206 as indicated by the arrow 216, when such is desired. As in FIGS. 7 and 9, support 214 may be provided with rapid and fine vertical motions, suggested by the arrow 217.

OPERATION OF THE THIRD EMBODIMENT

The general operation of this embodiment of the invention is as that described for the second embodiment: two added factors are present, however, which must be mentioned specifically.

As a factor of convenience, table 205 may be withdrawn from under cutting head 200 for mounting workpieces without interference, after which the workpiece can be moved under the cutter head by hydraulic motor 215. Thereafter the workpiece is raised and rough-cut as described above, while belt 204 remains centered. Vertical feed is then arrested.

A special feature of the third embodiment lies in the fact that the workpiece can be withdrawn laterally from the belt while both are still in operation, this withdrawl being aligned with the working edge of the belt. It has been found that this final step increases both the flatness of the finished workpiece and the perfection of the dressing of the belt.

From the foregoing it will be evident that I have invented a new procedure for using abrasive belts for production grinding of surfaces of great flatness with unprecedented economy of belt usage, as well as three different structures by which the inventive procedure may be carried out. The procedure comprises the steps of rotating the workpiece about an axis and simultaneously bringing about linear relative motion between the workpiece and the belt having at least a component aligned with the working edge of the belt. In one of the embodiments the belt is narrower than the axial dimension of the drums, and the linear motion is accomplished by causing oscillation of the belt axially on the drum.

Numerous characteristics and advantages of the invention have been set forth in the foregoing description, together with details of the structure and function of the invention, and the novel features thereof are pointed out in the appended claims. The disclosure, however, is illustrative only, and changes may be made in detail, especially in matters of shape, size, and arrangement of parts, within the principle of the invention, to the full extent indicated by the broad general meaning of the terms in which the appended claims are expressed.

What is claimed is:

1. A method of precision planar surface grinding a workpiece with an endless abrasive belt of predetermined width, comprising the steps of:

(a) imparting continuous circulating movement to the endless abrasive belt through a grinding area to define a region of abrasive workpiece engagement extending over the entire width of the belt;

(b) rotating the workpiece in a plane that is substantially parallel to the region of abrasive workpiece engagement of said endless abrasive belt to present a grinding surface of predetermined maximum transverse dimension to the region of abrasive workpiece engagement;

(c) effecting relative back and forth reciprocating movement between the workpiece and said region of abrasive workpiece engagement along a line that is substantially parallel to said plane of rotation, said relative movement being of sufficient magnitude that the rightmost edge of the belt reaches the leftmost edge of the rotating workpiece and the leftmost edge of the belt reaches the rightmost edge of the rotating workpiece, so that during each reciprocating stroke the entire grinding surface of the workpiece moves through the entire width of the region of abrasive workpiece engagement, whereby every point on the workpiece is abrasively engaged by every point of the endless abrasive belt.

2. A method of precision surface grinding a workpiece with an endless abrasive belt of predetermined width, comprising the steps of:

(a) imparting a continuous circulatory movement to the belt through a grinding area to define a region of abrasive workpiece engagement;

(b) rotating the workpiece in a plane that is substantially parallel to said region to define a grinding surface on the workpiece having a predetermined maximum transverse dimension;

(c) effecting relative reciprocating movement between the workpiece and said region on the belt by moving said grinding surface of the workpiece across the belt such that the travel of said belt measured from leftmost peak to rightmost peak is not less than twice the width of said maximum transverse dimension plus the width of the belt said relative movement being of sufficient magnitude that the rightmost edge of the belt reaches the leftmost edge of the rotating workpiece and the leftmost edge of the belt reaches the rightmost edge of the rotating workpiece, so that every point on the workpiece is abrasively engaged by every point on the endless abrasive belt.

3. A method of precision planar surface grinding of a workpiece by an endless abrasive belt with a linear working edge comprising the steps of:

(1) imparting a circulatory movement in the belt so that the working edge is constantly moving over the workpiece at the region of abrasive engagement, (2) rotating the workpiece on a planar holder, (3) causing the edge to contact the workpiece surface during said circulatory movement, (4) moving the workpiece generally along a line parallel to the working edge, said movement having a minimum travel measured between right and leftmost deviations of twice the width of the workpiece plus the greatest transverse dimension of the abraded surface, so that at one peak the leftmost edge of the belt will contact the rightmost edge of the rotating workpiece surface and at the other peak the rightmost edge of the belt will contact the leftmost edge of the abraded surface.

4. A method of two-step grinding to achieve a precision ground surface on a workpiece with endless abrasive belt grinder having a linear working edge, comprising the steps of:

locating a workpiece surface proximate said working edge, rotating said workpiece about its central axis, contacting said working edge and the workpiece to rapidly abrade the surface thereof, dressing the workpiece by causing relative reciprocal movement of the belt and workpiece generally along an axis parallel with said working edge, said movement being of sufficient magnitude so that during each reciprocated stroke the entire abraded surfaces moves across the entire width of the belt, edge to edge, said relative movement being of sufficient magnitude that the rightmost edge of the belt reaches the leftmost edge of the rotating workpiece and the leftmost edge of the belt reaches the rightmost edge of the rotating workpiece whereby every point on the abraded surface of the workpiece engages every point on the endless belt.

* * * * *